United States Patent [19]

Linder et al.

[11] Patent Number: 4,667,950

[45] Date of Patent: May 26, 1987

[54] APPARATUS FOR CHANGING THE SPACING BETWEEN THE LEADERS OF SUCCESSIVE SHEETS IN A STREAM OF PARTIALLY OVERLAPPING SHEETS

[75] Inventors: Heinz Linder, Zofingen; Kurt Heutschi, Wikon, both of Switzerland

[73] Assignee: Grapha-Holding AG, Hergiswil, Switzerland

[21] Appl. No.: 329,520

[22] Filed: Dec. 10, 1981

[30] Foreign Application Priority Data

Dec. 11, 1980 [CH] Switzerland ..... 9139/80

[51] Int. Cl.[4] ..... B65H 9/06

[52] U.S. Cl. ..... 271/245; 271/237

[58] Field of Search ..... 271/237, 239, 245, 246, 271/247

[56] References Cited

U.S. PATENT DOCUMENTS

| | | | |
|---|---|---|---|
| 672,529 | 4/1901 | Hunter | 271/245 |
| 3,716,228 | 2/1973 | Bottcher | 271/246 |
| 4,046,369 | 9/1977 | Kluge | 271/237 X |

OTHER PUBLICATIONS

Xerox Disclosure Journal, vol. 2, No. 3, p. 49, "Document Feeder Without Register Gates", Charles J. Mahler.

*Primary Examiner*—Richard A. Schacher

*Attorney, Agent, or Firm*—Peter K. Kontler

[57] ABSTRACT

A stream of partially overlapping paper sheets is advanced below one or more wheels which are driven by the sheets and transmit torque to one or more rotary disc cams which cooperate with a roller follower provided on an intercepting device having a pallet which can be moved into and retracted from the path of movement of oncoming leaders of successive sheets. The periods of dwell of the pallet in the path of movement of the leader of each sheet are selected in such a way that the spacing between successive leaders is equalized to match the sum of spacings of successive leaders divided by the number of such leaders. A leaf spring biases the roller follower against the periphery of peripheries of the cam or cams. The transporting unit which advances the stream past the equalizing station for the pallet of the intercepting device is driven independently of the conveyor or conveyors which deliver sheets to the transporting unit and/or of the conveyor or conveyors which receive equalized sheets from the transporting unit.

18 Claims, 5 Drawing Figures

P
3a
3
t
t
A
3a
14
t1
4
t2
t3
tn
1
1A
2
17
10
11
13
16
5
5a
15
6a
8
6
7
9

13
13
10
11
11
12
8
9

APPARATUS FOR CHANGING THE SPACING BETWEEN THE LEADERS OF SUCCESSIVE SHEETS IN A STREAM OF PARTIALLY OVERLAPPING SHEETS

BACKGROUND OF THE INVENTION

The present invention relates to apparatus for processing paper sheets or the like, and more particularly to improvements in appaaratus for processing sheets which form a so-called scalloped stream wherein successive sheets partially overlap the preceding sheets. Still more particularly, the invention relates to improvements in apparatus for changing (when necessary) the spacing between the leaders of successive sheets in a continuous stream of partially overlapping sheets. Each such sheet can constitute a single layer, a folded sheet wherein the fold line is normally located at the leading end, or a group (e.g., a signature) consisting of three or more overlapping leaves.

It is well known to advance a stream of partially overlapping paper sheets or the like by a transporting unit (for example, an endless belt conveyor) which is caused to move stepwise through distances or increments of predetermined length, namely, through distances which correspond to the desired or required spacing between the leaders of successive sheets. Reference may be had, for example, to German Offenlegungsschriften Nos. 25 18 373 and 26 17 975. The prior publications disclose grippers or entraining elements which are adjacent to the path of movement of the stream of partially overlapping sheets and are movable into engagement with the sheets of such stream. The entraining elements or grippers are thereupon moved relative to each other by a worm wheel or a like displacing device so as to be spaced apart by distances corresponding to the desired spacing between the leaders of successive sheets of the stream. Once the stream has been treated, the grippers or entraining elements are disengaged therefrom and are moved back to the forward end of the portion of the path of movement of the stream where the action of establishing uniformity begins. The path along which the grippers or entraining elements move includes a magazine for temporary storage of superfluous sheet engaging devices. A drawback of such conventional apparatus is that their initial and maintenance costs very high and also that their space requirements greatly exceed the availability of space in many types of sheet processing plants. For example, such plants can employ newspaper printing and assembly machines or apparatus which assemble sheets into signatures prior to binding of signatures to form pamphlets, brochures, books or similar products.

OBJECTS AND SUMMARY OF THE INVENTION

An object of the invention is to provide a novel and improved apparatus which can equalize the spacing between the leaders of successive sheets in a stream of partially overlapping sheets in a small area and with a high degree of predictability and accuracy.

Another object of the invention is to provide a simple and compact apparatus which can treat sheets of any desired size, thickness and/or shape.

A further object of the invention is to provide the apparatus with novel and improved means for engaging and arresting (if necessary) successive sheets on their way from a preceding to a next-following processing station.

An additional object of the invention is to provide an apparatus wherein a single component suffices to engage and properly orient each of a series of successive sheets in a stream of partially overlapping sheets.

A further object of the invention is to provide the above-outlined apparatus with novel and improved means for transmitting motion to that component which comes or can come into direct contact with the leaders of successive sheets of the stream.

Still another object of the invention is to provide the apparatus with novel and improved means for synchronizing the movements of the sheet engaging component with movements of means for transporting the stream of partially overlapping sheets.

A further object of the invention is to provide a simple and compact apparatus which can be installed in existing production lines as a superior and simpler substitute for heretofore known apparatus which equalize the spacing between the leaders of successive sheets of a stream of partially overlapping sheets.

Another object of the invention is to proved the apparatus with a sheet engaging device which need not receive motion from a separate prime mover so that the energy requirements of the improved apparatus are negligible or nil.

An additional object of the invention is to provide the apparatus with novel and improved means for invariably preventing misorientation of sheets with reference to each other and/or with reference to the sheet transporting means.

Another object of the invention is to provide a highly versatile apparatus which can be rapidly and conveniently converted for the treatment of relatively large, relatively small, slightly overlapping or pronouncedly overlapping paper sheets or the like.

The invention is embodied in an apparatus for establishing a uniform spacing between the leaders of successive sheets in a stream of partially overlapping sheets. The apparatus comprises means (for example, an endless belt conveyor or a series of parallel endless belt conveyors) for transporting the stream in a predetermined direction through successive increments whose length at least approximates but preferably matches the desired spacing between the leaders of successive sheets, an intercepting device (for example, a pawl having a pallet) movable into and from the path of movement of successive oncoming leaders, mobile displacing means for moving the intercepting device relative to the transporting means and with reference to the steam of sheets on the transporting means, and means for synchronizing the movements of the displacing means with the movements of the transporting means so that the intercepting device enters the path of an oncoming leader before and leaves such path when the transporting means completes the transport of the stream through one of the aforementioned increments.

The synchronizing means preferably includes means for transmitting motion from the transporting means to the displacing means, and such motion transmitting means can comprise at least one wheel or an analogous rotary element which is rotatable about an axis extending at least substantially at right angles to the direction of movement of the stream. The wheel can receive motion directly from the transporting means so that its peripheral speed matches the speed of movement of the steam. In accordance with a presently preferred embodiment of the invention, the wheel engages successive sheets of the stream on the transporting means so that the moving sheets drive the wheel which, in turn, drives the displacing means for the intercepting device in synchronism with movements of the transporting means. As mentioned before, the transporting means comprises or can comprise one or more conveyors which are arranged to advance the sheets in a predetermined plane (for example, in a substantially horizontal plane). In such apparatus, the aforementioned axis is preferably parallel to the horizontal plane and extends transversely of the path of movement of successive leaders in or adjacent to the horizontal plane.

The displacing means preferably comprises a cam (for example, a disc cam) which is coaxial with and is rotated by the wheel. The intercepting device then includes a roller or other suitable follower means which tracks the cam. It is preferred to mount the cam and the wheel on a common shaft which defines the aforementioned axis and can be mounted at the free end of a lever which is turnable about the axis of a fixed fulcrum. The lever can further support a leaf spring or other suitable means for biasing the follower means against the cam.

In accordance with another embodiment of the invention, the shaft for the wheel and the cam need not be driven by the transporting means and/or by the stream of partially overlapping sheets. Instead, the shaft can be driven by a means which drives the transporting means, for example, by a motor which drives one or more pulleys for the conveyor or conveyors of the transporting means. The transporting means can comprise a conveyor which forms part of a processing machine serving to receive and treat the sheets. The processing machine can stack and/or otherwise treat the sheets after the sheets advance beyond the intercepting device.

The novel features which are considered characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
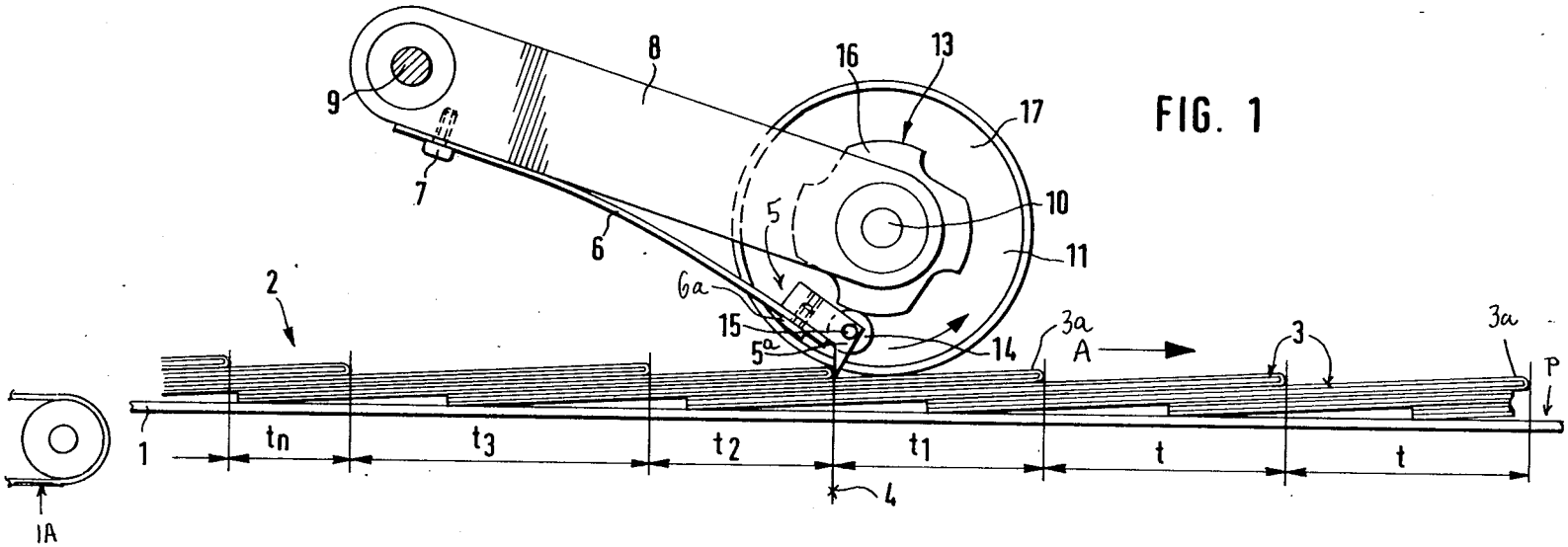
FIG. 1 is a fragmentary schematic side elevational view of the transporting unit and an elevational view of other constituents of an apparatus which embodies one form of the present invention.
Figure 2:
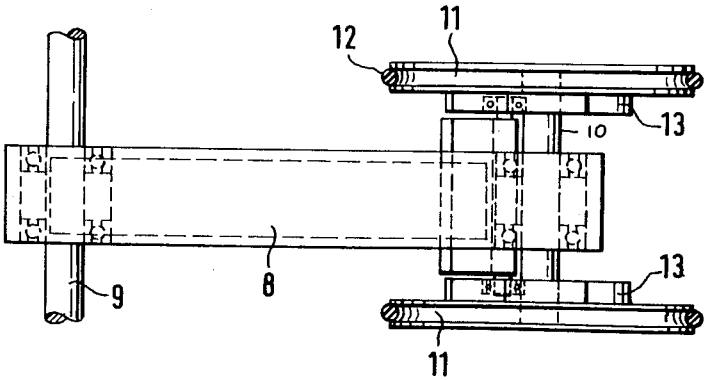
FIG. 2 is a plan view of the apparatus of FIG. 1, with the transporting unit and the stream of partially overlapping sheets omitted.

Referring first to FIGS. 1 and 2, there is whown a portion of a transporting unit 1 which may include one or more endless belt or chain conveyors serving to advance a stream 2 of partially overlapping paper sheets 3 along a horizontal path and past an equalizing station 4. The leaders of successive sheets 3 are shown at 3*a*. The desired spacing between the leaders 3*a* of successive sheets 3 is shown at t. Each sheet 3 may constitute a folded article which has two overlapping panels or leaves with a fold line located in the region of the respective leader 3*a*. It will be seen that the spacing between the leaders 3*a* of successive sheets 3 approaching the equalizing station 4 varies within a rather wide range. For example, the spacing t1 exceeds the next-following spacing t2, the spacing t1 or t2 is less than the next-following spacing t3 but exceeds the next-following spacing tn, and so forth. The function of the improved apparatus is to establish a uniform spacing between successive leaders 3*a* so that each such spacing will equal t. This is desirable, for example, when the transporting unit 1 serves to advance a stream 2 of partially overlapping sheets 3 from a folding station to an inserting station where the sheets are inserted into sections of newspapers or the like.

It will be noted that the apparatus serves to eliminate the differences between successive spacings t1, t2, t3 . . . tn and to convert each such spacing into a distance t which is the same from sheet to sheet. In other words, the apparatus changes each of the spacings t1 . . . tn to an average spacing tm which is obtained by adding up the spacings t1 . . . tn and dividing the resulting sum by n wherein n is the total number of sheets in a selected stretch of the path defined by the transporting unit 1. The averaged spacing tm equals the spacings t shown in the right-hand portion of FIG. 1.

The transporting unit 1 can advance the stream 2 stepwise or continuously. Irrespective of the mode of operation of the means for driving the transporting unit 1, this unit is arranged to transport the stream 2 in the direction of arrow A through successive increments whose length approximates but preferably matches the desired spacing (t) between the leaders 3*a* of successive sheets 3. The desired spacing t can be greater or less than the spacing between the leaders 3*a* of successive sheets 3 in that portion of the horizontal path defined by the transporting unit 1 which precedes the equalizing station 4. If the spacing t exceeds the spacing of sheets 3 ahead of the station 4, the machine in which the improved apparatus is put to use must be equipped with a suitable system for preventing undesirable accumulation of sheets ahead of the station 4. Furthermore, care should be taken to avoid accurate or full overlapping of two sheets ahead of the station 4 because two or more fully overlapping sheets will be treated as a single sheet. Complete overlapping of two or more sheets can take place if the illustrated portion of the transporting unit 1 is driven at a speed greatly exceeding the speed of the preceding portion (1A) of the transporting unit.

If the spacing t is to be less than the spacing between the sheets 3 approaching the equalizing station 4, the speed of the illustrated portion of the transporting unit 1 should preferably constitute a fraction of the speed of that portion (1A) of the transporting unit which delivers sheets toward the equalizing station 4. Such selection of the speeds of various sections of the transporting unit ensures that no gaps will develop between successive sheets 3 downstream of the equalizing station 4.

In addition to the transporting unit 1 (or that portion of the transporting unit 1 which advances the stream 2 past the equalizing station 4), the improved apparatus comprises an intercepting device 5 which includes or constitutes a pawl having a pallet 5*a* movable up and down, as viewed in FIG. 1, i.e., into and from the path of movement of successive oncoming leaders 3*a* on the transporting unit 1. The pawl of the intercepting device 5 is separably secured to the adjacent end portion of an elastic supporting arm 6 which constitutes a simple leaf spring. The connection between the pawl and the leaf spring 6 includes one or more screws 6*a*. The rear end portion of the leaf spring 6 is separably connected to a lever 8 by one or more screws 7 or analogous fasteners. The left-hand end portion of the lever 8 is turnable about the axis of a fixed fulcrum 9 which is a horizontal pivot pin mounted in the frame (not shown) of the machine which embodies or cooperates with the improved apparatus. The right-hand end portion of the lever 8 supports a rotatable horizontal shaft 10 which extends transversely of the direction (arrow A) of movement of the stream 2 and is parallel to the horizontal plane P defined by the transporting unit 1 in the region of the equalizing station 4. This station is defined by the position of the pallet 5*a* of the pawl of the intercepting device 5.

The shaft 10 is rigidly connected with two spaced-apart disc cams 13 which, in turn, are rigidly connected with rotary elements in the form of wheels 11 having solid tires 12 consisting of rubber or other suitable friction generating elastomeric material and partially recessed into the circumferential grooves of the respective wheels. The cams 13 constitute a displacing means for moving the intercepting device 5 intermittently into and from the path of oncoming leaders 3*a*, and the wheels 11 constitute a means for synchronizing the movements of the cams 13 with the movement of the transporting unit 1 so that the intercepting device 5 enters the path of movement of an oncoming leader 3*a* before and leaves such path when the transporting unit 1 completes the transport of the stream 2 through one of the aforementioned increments, namely, through a distance t. When the cams 13 cause the intercepting device 5 to move its pallet 5*a* into the path of movement of an oncoming leader 3*a*, the tip of the pallet 5*a* comes or can come to rest on the upper side of the preceding sheet 3, and such sheet slides relative to the pallet until the transport of the sheet through the distance t is completed. The spring 6 then causes the pallet 5*a* to leave the path of the leader 3*a* which is in engagement therewith so that the corresponding (next-following) sheet 3 can advance in the direction which is indicated by the arrow A without any interference on the part of the intercepting device 5. The pawl 5*a* of the intercepting device 5 carries a horizontal shaft 15 which is parallel to the shaft 10 and supports a roller follower 14 which is biased against the peripheral surfaces of the cams 13 by the leaf spring 6. The peripheral surfaces of the cams 13 have alternating lobes 16 and valleys 17 whereby the follower 14 causes the pallet 5*a* to descend when the follower rides along a pair of aligned lobes 16 and the spring 6 causes the pallet 5*a* to rise when the follower 14 enters the next-following pair of aligned valleys 17.

The wheels 11 invariably synchronize the movements of the cams 13 with the movements of the transporting unit 1 because the outwardly extending portions of their tires 12 are in frictional engagement with the exposed surfaces of successive sheets 3 which are driven by the unit 1. It is clear that a single wheel 11 and a single cam 13 will suffice to cause the intercepting device 5 to move up and down at required intervals. The illustrated arrangement is preferred because it further reduces the likelihood of slippage of sheets 3 and transporting unit 1 with reference to pheripheral surfaces of the wheels 11 and thereby further reduces the likelihood of improper timing of upward and downward movements of the intercepting device 5. The roller follower 14 may constitute an elongated rotary body which is in simultaneous contact with the two disc cams 13. Alternatively, the shaft 15 can carry two relatively short roller followers 14 each of which is biased against the corresponding cam 13 by a discrete leaf spring 6. If desired, the right-hand end of the spring 6 can bear against the median portion of the shaft 15, i.e., the spring 6 need not directly engage the pawl of the intercepting device 5.

The length of each lobe 16 and each valley 17 on each of the two cams 13 is selected in such a way that the pallet 5*a* invariably descends into the path of an oncoming leader 3*a* before such leader reaches the equalizing station 4, and that the pallet is withdrawn from the path of such leader not later than when the distance between the engaged leader and the preceding leader 3*a* equals t.

Once the pallet 5*a* is retracted, the leading edge 3*a* of the freshly adjusted or equalized sheet 3 is permitted to advance beyond the station 4 and the cams 13 thereupon cause the follower 14 to return the intercepting device 5 to the position which is shown in FIG. 1 whereby the pallet 5*a* descends onto or close to the upper side of the freshly equalized sheet 3 therebelow. The spring 6 again lifts the intercepting device 5 as soon as the distance between the next-following leader 3*a* and the leader 3*a* of the freshly equalized sheet 3 reaches the value t. The same mode of operation is repeated again and again so that all of the sheets 3 in the stream 2 are shifted (if necessary) with reference to each other to obtain a uniform spacing t between successive leaders 3*a*. The number of lobes 16 and valleys 17 on each of the cams 13 is selected in such a way that, during each cycle of the machine which embodies the improved apparatus, the intercepting device 5 is lowered once and raised once in order to achieve the aforediscussed uniform spacing t. If desired, the spacing t can be increased or reduced by the simple expedient of replacing the illustrated cams 13 with cams having lobes 16 and valleys 17 in different distribution. In other words, such spacing can be increased by reducing the number of lobes 16 and such spacing can be reduced by increasing the number of lobes. The just discussed adjustment of the distances or spacings t can also be achieved by replacing the wheels 11 with wheels having larger or smaller diameters. All that counts is to ensure that the intercepting device 5 can move its pallet 5*a* into and from the path of movement of successive leaders 3*a* once during each cycle of operation of the machine which embodies the improved apparatus.

Figure 1A:
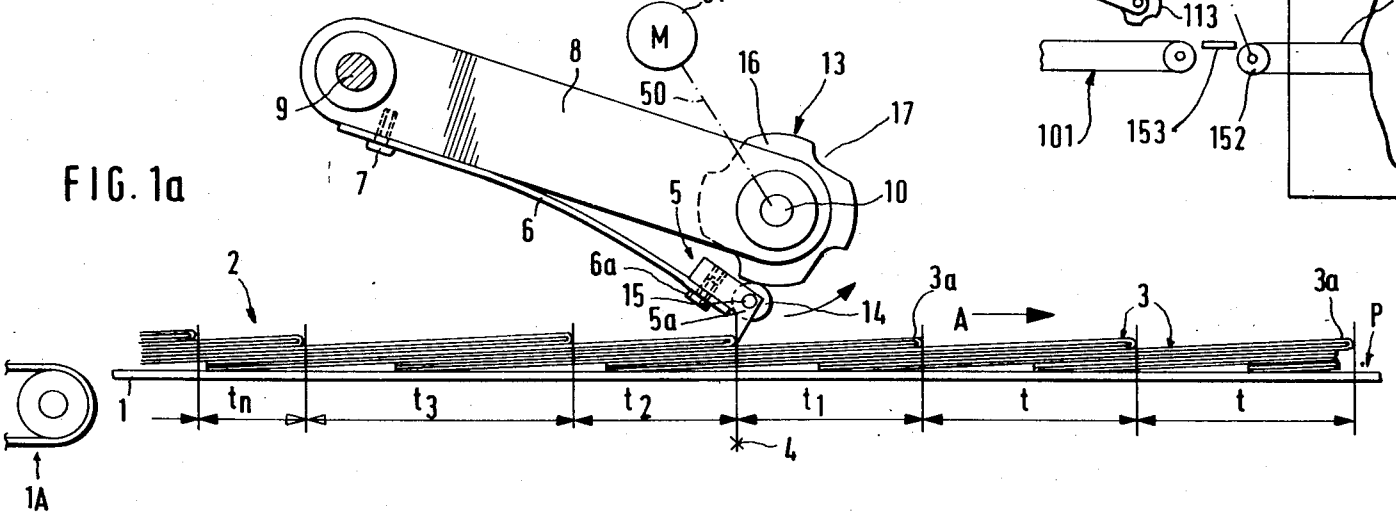
FIG 1*a* is a similar view of a modified apparatus.

It is further within the purview of the invention to provide a direct connection between the prime mover for the transporting unit 1 and the shaft 10. In such modified apparatus, the wheels 11 are omitted (see FIG. 1*a*) because the shaft 10 is driven in synchronism with movements of the transporting unit 1 by the operative connection which is indicated in FIG. 1*a* by a broken line 50. The prime mover for the transporting unit 1 of FIG. 1*a* is shown at 51.

Figure 3:
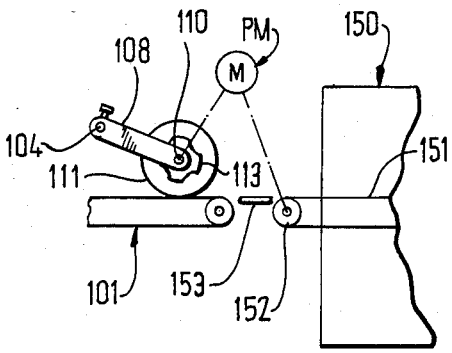
FIG. 3 is a schematic elevational view of an apparatus wherein the means for moving the intercepting device receives motion from a prime mover serving to drive a conveyor which forms part of a sheet processing machine.

In accordance with a further modification which is shown in FIG. 3, the shaft 110 (which is a functional equivalent of the shaft 10 shown in FIG. 1) is driven by a prime mover PM which also serves to transmit torque to one pulley or sprocket wheel 152 of a belt or chain conveyor 151 forming part of or cooperating with a processing machine 150. The reference character 101 denotes a transporting unit which includes the conveyor 151 and is a functional equivalent of the transporting unit 1 shown in FIG. 1. The wheel or wheels 111 can rotate on the shaft 110 and maintain the shaft 110 at a desired distance from the upper reach of the transporting unit 101, namely, at a desired distance from the plane of the stream of partially overlapping sheets which are not specifically shown in FIG. 3. A short bridge 153 is provided to guide successive sheets of the stream during transfer from the transporting unit 101 onto the conveyor 151.

Figure 4:
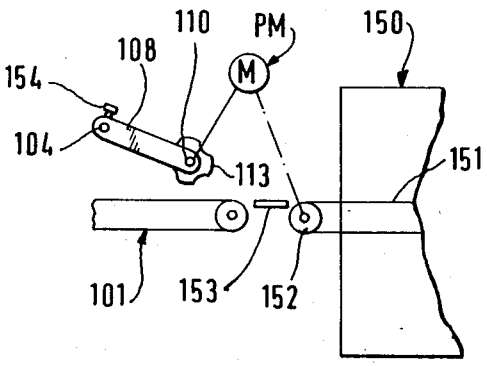
FIG. 4 is a view of a portion of an apparatus which constitutes a modification of that shown in FIG. 3.

The wheel or wheels 111 can be omitted (see FIG. 4) if the angular position of the lever 108 for the shaft 110 with reference to the fixed fulcrum 104 can be adjusted and thereupon maintained in a selected position, for example, by means of a screw 154.

An important advantage of the improved apparatus is that it occupies a small amount of space and can be readily installed in existing production lines for the processing of sheets 3 or analogous sheets. The dimensions of the cam or cams 13 or 113 are relatively small, the same as the diameters of the wheels 11 or 111. This means that such apparatus can be readily accommodated in existing machines at a level above the transporting unit which delivers a scalloped stream to a stacking, inserting or other station.

As mentioned before, the stream of partially overlapping sheets can develop gaps if that portion or section of the transporting unit which is adjacent to the equalizing station advances at the speed of the preceding portion or section and/or next-following portion or section of the same unit. Therefore, it is often advisable to provide a separate drive (such as 51) for the transporting unit section which is adjacent to the intercepting device 5. The just mentioned separate drive for the transporting unit section in the region of the intercepting device further reduces the likelihood of formation of a stream wherein two sheets fully overlap each other so that the intercepting device treats such fully overlapping sheets as a single sheet. The just mentioned potential drawbacks are eliminated by the simple expedient of driving the transporting unit section which advances the sheets past the equalizing station at a speed which is different from the speed of means (1A) for delivering sheets 3 and/or means (151) for receiving equalized sheets from such section.

Without further analysis, the foregoing will so fully reveal the gist of the present invention that others can, by applying current knowledge, readily adapt it for various applications without omitting features that, from the standpoint of prior art, fairly constitute essential characteristics of the generic aand specific aspects of our contribution to the art and, therefore, such adaptations should and are intended to be comprehended within the meaning and range of equivalence of the appended claims.

We claim:

1. An arrangement for processing a stream of partially overlapping sheets, said arrangement having an apparatus for establishing a substantially uniform spacing between the leaders of successive sheets of the stream, and said apparatus comprising:

(a) transporting means for transporting the stream in a predetermined direction along a predetermined path;

(b) driving means for said transporting means;

(c) an intercepting device movable into and from said path, said intercepting device being arranged to move into said path to an extent such that said intercepting device blocks the leader of a first sheet while permitting a second sheet which partly overlaps the first sheet to continue along said path;

(d) mobile displacing means for moving said device into and from said path; and (e) synchronizing means movable in response to said driving means to synchronize the movements of said displacing means and said transporting means so that said device enters said path before and leaves said path when said transporting means completes transport of the stream through a distance which at least approximates said spacing.

2. The apparatus of claim 1, wherein said synchronizing means includes means for transmitting motion from said transporting means to said displacing means.

3. The apparatus of claim 2, wherein said motion transmitting means comprises at least one rotary element rotatable about an axis which is at least substantially normal to said direction.

4. The apparatus of claim 3, therein said rotary element comprises at least one wheel which receives motion from said transporting means so that its peripheral speed matches the speed of movement of the stream in said direction.

5. The apparatus of claim 3, wherein said transporting means comprises a conveyor arranged to advance the sheets of the stream in a predetermined plane and said axis is parallel to such plane.

6. The apparatus of claim 3, wherein said displacing means comprises a cam which is coaxial with and rotated by said rotary element, said device including follower means tracking said cam.

7. The apparatus of claim 6, comprising a common shaft defining said axis and supporting said rotary element and said cam.

8. The apparatus of claim 3, wherein said displacing means comprises a cam which is driven by said rotary element, and said device comprises follower means tracking said cam; and further comprising means for biasing said follower means against said cam.

9. The apparatus of claim 8, wherein said biasing means comprises a leaf spring.

10. The apparatus of claim 1, wherein said displacing means comprises a rotary component and said synchronizing means comprises a shaft supporting said rotary component.

11. The apparatus of claim 10, wherein said shaft is connected with said driving means.

12. The apparatus of claim 10, comprising a prime mover connected with said shaft, and further comprising a processing machine containing a section of said transporting means, said section receiving motion from said prime mover.

13. The apparatus of claim 1, wherein said device includes a pawl and a follower, and said displacing means comprises a cam guiding said follower for moving said pawl into and from said path.

14. Apparatus for establishing a substantially uniform spacing between the leaders of successive sheets of a stream of partially overlapping sheets comprising:

(a) transporting means for transporting the stream in a predetermined direction through successive increments whose lengths at least approximate the desired spacing between the leaders of successive sheets, said transporting means including a conveyor arranged to advance the sheets of the stream in a predetermined plane;

(b) an intercepting device movable into and from the path of movement of successive oncoming leaders, said intercepting device being arranged to move into said path to an extent such that said intercepting device blocks the leader of a first sheet while permitting a second sheet which partly overlaps the first sheet to continue along said path;

(c) mobile displacing means for moving said device relative to said transporting means and relative to the stream of sheets thereon; and (d) means for synchronizing the movements of said displacing means with the movements of said transporting means so that said device enters the path of an oncoming leader before and leaves such path when said transporting means completes the transport of the stream through one of said increments, said synchronizing means including means for transmitting motion from said transporting means to said displacing means, and said motion transmitting means comprising at least one rotary element rotatable about an axis which is substantially normal to said direction and substantially parallel to said plane, said rotary element including at least one wheel which receives motion from said transporting means so that its peripheral speed matches the speed of movement of the stream in said direction.

15. Apparatus for establishing a substantially uniform spacing between the leaders of successive sheets of a stream of partially overlapping sheets, comprising means for transporting the stream in a predetermined direction through successive increments whose lengths at least approximate the desired spacing between the leaders of successive sheets, said transporting means including a conveyor arranged to advance the sheets of the stream in a predetermined plane; an intercepting device movable into and from the path of movement of successive oncoming leaders; mobile displacing means for moving said device relative to said transporting means and relative to the stream of sheets thereon; and means for synchronizing the movements of said displacing means with the movements of said transporting means so that said device enters the path of an oncoming leader before and leaves such path when said transporting means completes the transport of the stream through one of said increments, said synchronizing means including means for transmitting motion from said transporting means to said displacing means, and said motion transmitting means comprising at least one rotary element rotatable about an axis which is substantially normal to said direction and parallel to said plane, said rotary element including at least one wheel which receives motion from said transporting means so that its peripheral speed matches the speed of movement of the stream in said direction, and said wheel contacting and being driven by successive sheets of the stream on said transporting means.

16. Apparatus for establishing a substantially uniform spacing between the leaders of successive sheets of a stream of partially overlapping sheets, comprising means for transporting the stream in a predetermined direction through successive increments whose lengths at least approximate the desired spacing between the leaders of successive sheets; an intercepting device movable into and from the path of movement of successive oncoming leaders; mobile displacing means for moving said device relative to said transporting means and relative to the stream of sheets thereon, said displacing means including a cam, and said device comprising follower means tracking said cam; means for biasing said follower means against said cam; a pivotable lever supporting said cam and said biasing means; and means for synchronizing the movements of said displacing means with the movements of said transporting means so that said device enters the path of an oncoming leader before and leaves such path when said transporting means completes the transport of the stream through one of said increments, said synchronizing means including means for transmitting motion from said transporting means to said displacing means, and said motion transmitting means comprising at least one rotary element rotatable about an axis which is substantially normal to said direction, said cam being driven by said rotary element.

17. The apparatus of claim 16, comprising a shaft supported by said lever and carrying said rotary element so that the latter is coaxial with said cam.

18. Apparatus for establishing a substantially uniform spacing between the leaders of successive sheets of a stream of partially overlapping sheets, comprising means for transporting the stream in a predetermined direction through successive increments whose lengths at least approximate the desired spacing between the leaders of successive sheets; an intercepting device movable into and from the path of movement of successive oncoming leaders; mobile displacing means for moving said device relative to said transporting means and relative to the stream of sheets thereon, said displacing means comprising a rotary cam; a pivotable lever; a shaft rotatably mounted in said lever; and means for synchronizing the movements of said displacing means with the movements of said transporting means so that said device enters the path of an oncoming leader before and leaves such path when said transporting means completes the transport of the stream through one of said increments, said synchronizing means including means for transmitting motion from said transporting means to said displacing means, and said motion transmitting means comprising at least one rotary element rotatable about an axis which is substantially normal to said direction, said rotary element including a wheel which is driven by the stream on said transporting means and is coaxially secured to said shaft, and said cam being coaxial with and receiving torque from said wheel.

* * * * *